US009598265B1

(12) United States Patent
Jacobs

(10) Patent No.: US 9,598,265 B1
(45) Date of Patent: Mar. 21, 2017

(54) VERTICALLY AND HORIZONTALLY MOBILE ELEVATOR CABINS

(71) Applicant: Smart Lifts, LLC, Menlo Park, CA (US)

(72) Inventor: Justin Jacobs, Menlo Park, CA (US)

(73) Assignee: Smart Lifts, LLC, Menlo Park, CA (US)

( * ) Notice: Subject to any disclaimer, the term of this patent is extended or adjusted under 35 U.S.C. 154(b) by 0 days.

(21) Appl. No.: 14/868,295

(22) Filed: Sep. 28, 2015

(51) Int. Cl.
*B66B 9/00* (2006.01)
*B66B 11/00* (2006.01)

(52) U.S. Cl.
CPC ..... *B66B 9/003* (2013.01); *B66B 11/009* (2013.01); *B66B 2009/006* (2013.01)

(58) Field of Classification Search
CPC ..... B66B 9/003; B66B 11/0095
See application file for complete search history.

(56) References Cited

U.S. PATENT DOCUMENTS 4,897,012 A * 1/1990 Brewer ..... B65G 67/603 187/407
5,090,515 A * 2/1992 Takahashi ..... B66B 9/00 187/249
5,584,364 A * 12/1996 Sakita ..... B66B 7/06 187/249
5,601,156 A 2/1997 McCarthy et al.
5,651,426 A * 7/1997 Bittar ..... B66B 1/2458 187/249
5,657,835 A 8/1997 Bittar
5,660,249 A 8/1997 Powell et al.
(Continued)

FOREIGN PATENT DOCUMENTS

CA 1265069 A 1/1990
EP 0367621 A1 5/1990
(Continued)

OTHER PUBLICATIONS

Frederick H. Barker: "A Technical Primer: The Otis Odyssey System," Oct. 30-31, 1997, pp. 55-76.
(Continued)

*Primary Examiner* — Minh Truong
(74) *Attorney, Agent, or Firm* — Intellectual Property Law Group LLP

(57) ABSTRACT

An elevator system permitting horizontal movement of a normally vertically moving elevator cabin, the elevator cabin being automatically attached to or detached from an elevator frame and horizontally moved to or from another elevator shaft or other destination. While an elevator cabin is supported on an elevator frame or other surface, various cables, rods, plugs and other equipment are automatically connected to or disconnected from the elevator cabin to enable vertical or horizontal motion of the elevator cabin. Once disconnected from such devices, the elevator cabin can be propelled horizontally out of the elevator frame and elevator shaft, onto other surfaces, such as floors of a building, and move horizontally to another destination. An elevator cabin may also be horizontally moved into an elevator shaft and onto the surface of an elevator frame, and connected to the frame, thus enabling such cabin to then move vertically within an elevator shaft.

27 Claims, 10 Drawing Sheets

(56) References Cited

U.S. PATENT DOCUMENTS

| | | | | |
|---|---|---|---|---|
| 5,752,585 | A * | 5/1998 | Bittar | B66B 1/2458 187/249 |
| 5,758,748 | A | 6/1998 | Barker et al. | |
| 5,771,995 | A | 6/1998 | Cooney et al. | |
| 5,773,772 | A | 6/1998 | McCarthy et al. | |
| 5,799,755 | A | 9/1998 | Wan et al. | |
| 5,816,368 | A | 10/1998 | Barrett et al. | |
| 5,823,299 | A * | 10/1998 | Wierschke | B66B 9/003 187/249 |
| 5,829,553 | A | 11/1998 | Wan et al. | |
| 5,861,586 | A | 1/1999 | McCarthy et al. | |
| 5,924,524 | A | 7/1999 | Barker et al. | |
| 7,913,818 | B2 * | 3/2011 | Kocher | B66B 9/00 187/249 |
| 8,307,952 | B2 * | 11/2012 | Fargo | B66B 9/00 187/251 |
| 2003/0132039 | A1 | 7/2003 | Gaffney et al. | |
| 2008/0247848 | A1 * | 10/2008 | Freudelsperger | B65G 1/0492 414/277 |
| 2011/0042168 | A1 | 2/2011 | Grundmann | |
| 2012/0193170 | A1 * | 8/2012 | Jacobs | B66B 11/0095 187/249 |
| 2013/0306408 | A1 * | 11/2013 | Jacobs | B66B 11/0095 187/249 |
| 2014/0034426 | A1 | 2/2014 | Novak | |
| 2015/0075916 | A1 | 3/2015 | Jacobs | |

FOREIGN PATENT DOCUMENTS

| | | | |
|---|---|---|---|
| EP | 0814049 | A1 | 12/1997 |
| EP | 2719650 | A1 | 4/2014 |
| JP | 2014-009099 | A | 1/2014 |

OTHER PUBLICATIONS

International Search Report, mailing date of Dec. 19, 2016, for corresponding International Application No. PCT/US2016/054237.
Written Opinion of the International Searching Authority, mailing date of Dec. 19, 2016, for corresponding International Application No. PCT/US2016/054237.

* cited by examiner

VERTICALLY AND HORIZONTALLY MOBILE ELEVATOR CABINS

CROSS-REFERENCE TO RELATED APPLICATIONS

This patent application is related to U.S. Pat. No. 8,430,210 B2 and U.S. Pat. No. 8,925,689 B2, which are hereby incorporated herein by reference in their entireties.

FIELD OF INVENTION

This invention relates generally to any elevator system where one or more elevator cabins are capable of both vertical and horizontal motion.

BACKGROUND

Conventional elevator cabins are only designed and used to transport passengers vertically up and down in one building. This results in constraints and inefficiencies when passengers in elevator cabins desire, or are required, to travel horizontally as well as vertically. For example, airplane passengers moving vertically in an elevator cabin to or from a parking garage or to or from a passenger arrival floor in one airport terminal building, may desire to move horizontally to a different floor in another distant airport terminal building. Presently, such passengers spend considerable time and effort boarding and leaving elevator cabins with their luggage, as well as walking or obtaining horizontal transportation, such as moving walkways, transit pods, inter-terminal trains/monorails, taxis, or shuttle buses, to go from a desired floor in one airline terminal building to a different desired floor in another terminal building. It would be more efficient and enjoyable if passengers and their luggage could remain in the same vehicle for the entire journey.

In addition, elevator systems capable of operating multiple elevator cabins in the same elevator shaft can be rendered largely inoperable by mechanical or electrical failures of a single cabin. If one cabin malfunctions or develops limited operational capability it could slow down or halt movement of the other elevator cabins in the same elevator shaft. Similarly, an elevator cabin may need to be remodeled, refurbished, or repaired over an extended period of time, or many packages in a cabin may need to be loaded or unloaded slowly and carefully from an elevator cabin into a distant room on a certain floor of a tall building.

Accordingly, there is a need to solve all of the aforementioned problems and limitations, by: 1) making it possible for elevator cabins to easily transfer back and forth between vertical and horizontal motion, and 2) by providing a method to remove an elevator cabin from an elevator frame quickly and efficiently. There is also a need for other uses or applications for elevator cabins that can easily transfer back and forth between vertical and horizontal motion.

SUMMARY

According to an embodiment of the present invention, there is an elevator system in a structure comprising: at least one vertical elevator shaft and at least one horizontal surface along a horizontal plane of the structure; one or more elevator cabins wherein each cabin is independently moveable with respect to each other cabin vertically through each vertical elevator shaft and horizontally moveable onto each horizontal surface. The at least one vertical elevator shaft comprises at least one vertically moveable elevator frame that is attachable to an elevator cabin; and each cabin is detachable from the at least one elevator frame and capable of horizontal movement on the at least one horizontal surface According to an embodiment, each elevator frame is suspended by a plurality of cables and is connected by cables to one or more counterweights. In another embodiment, each cable and each counterweight is located outside a vertical path of movement of each cabin and elevator frame.

Some embodiments of the present invention describe an elevator system which permits horizontal movement of a normally vertically moving elevator cabin. In one embodiment, an elevator cabin may be automatically attached to or detached from an elevator frame and then horizontally moved to or from another elevator shaft or other destination. While an elevator cabin is supported on an elevator frame or other surface, various cables, rods, plugs and other equipment may be automatically connected to or disconnected from the elevator cabin in order to enable vertical or horizontal motion of the elevator cabin. Once disconnected from all such devices, the elevator cabin can then be propelled horizontally on its own motorized wheels (or by another method) out of the elevator frame and elevator shaft and onto other surfaces, such as the floors of a building, and move horizontally to another destination. Similarly, an elevator cabin may also be horizontally moved into an elevator shaft and onto the surface of an elevator frame on its own motorized wheels (or by another method), and connected to the frame, thus enabling such cabin to then move vertically within an elevator shaft. By these methods it is also possible for an elevator cabin operating vertically in one building/structure to move horizontally to another building/structure and then operate vertically in that building/structure.

DETAILED DESCRIPTION OF THE INVENTION

Embodiments of the present invention are now described with reference to the figures where like reference numbers and letters indicate identical or functionally similar elements. Also, in the specification, the left most digit(s) of each reference number corresponds to the figure in which the reference number is first used. All elements of the present invention may be configured, composed, structured, positioned, and/or operated somewhat differently than as described herein.

Reference in the specification to "one embodiment" or to "an embodiment" means that a particular feature, structure, or characteristic described in connection with the embodiments is included in at least one embodiment of the invention. The appearance of the phrase "in one embodiment" in various places in the specification are not necessarily all referring to the same embodiment.

The language used in the specification has been principally selected for readability and instructional purposes, and may not have been selected to delineate or circumscribe the inventive subject. Accordingly, the disclosure of the present invention is intended to be illustrative, but not limiting, of the scope of the invention, which is set forth in the claims. Persons with ordinary skill in the art would be able to design other embodiments of the present invention without undo effort or experimentation.

Figure 1:
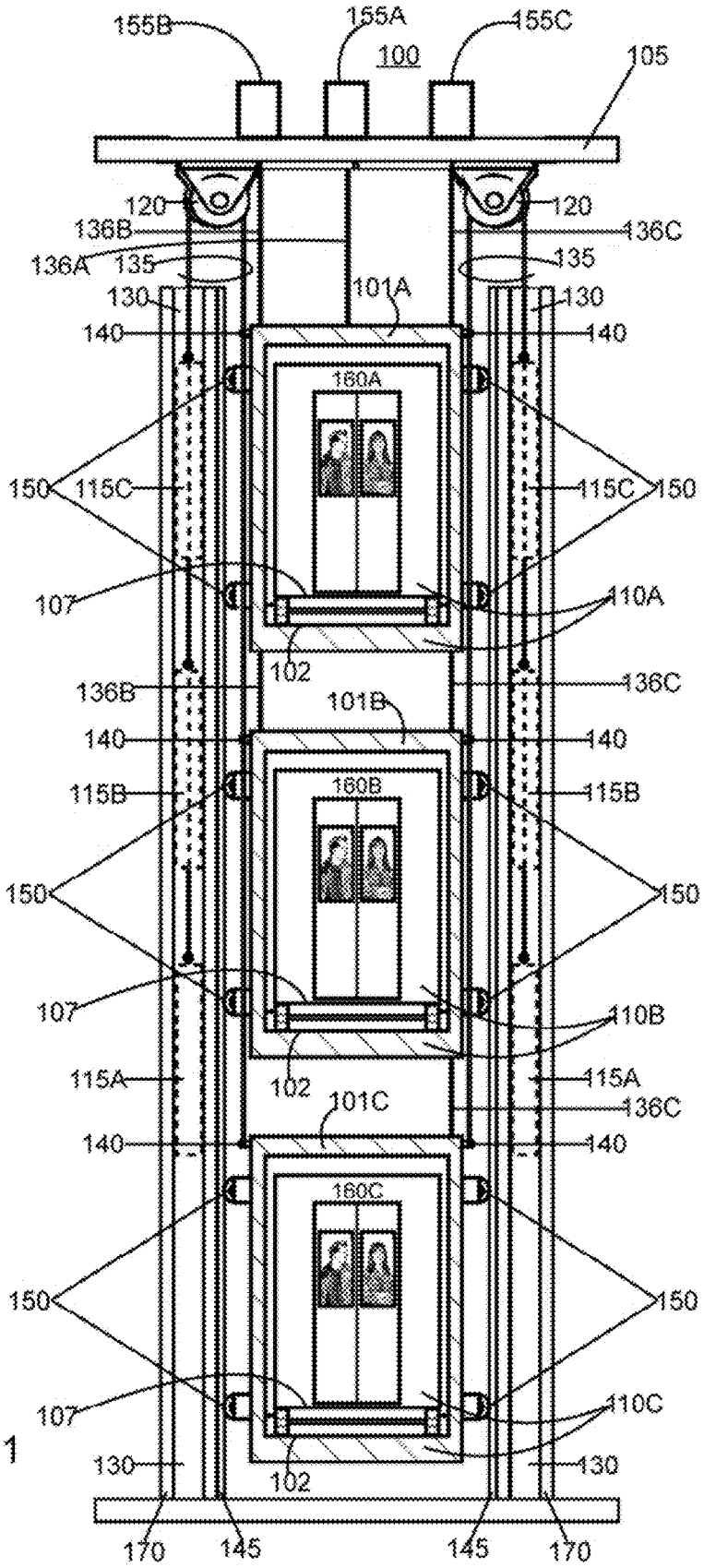
FIG. 1 is an illustration of the front view of an elevator shaft that contains three independently and vertically moving elevator frames, each frame containing a horizontally mobile elevator cabin, according to one embodiment of the present invention.

FIG. 1 is an illustration of the front view of three elevator frames 101A, 101B, 101C suspended by suspension cables 135 in an elevator shaft 100, according to one embodiment of the present invention. Each suspension cable 135 can be connected to a connection point 140 located on each elevator frame 101. Each connection point 140 can be positioned horizontally (not shown) and vertically away from each other connection point 140 in the elevator shaft 100. Each suspension cable 135 and each connection point 140 connected to the exterior of each elevator frame 101 can be located outside of the vertical path of each elevator frame 101 as it moves vertically through elevator shaft 100. Each suspension cable 135 can move up or down a side of elevator shaft 100, up and over a pulley 120 and down a counterweight channel 130 to the top of a counterweight 115, where said cable 135 can be connected to said counterweight 115. Each elevator frame 101 can have two or more guides 150 attached to its sides that can move along vertical guide tracks 145 attached to walls 170 of the elevator shaft 100. There can be a separate lift motor 155A, 155B, or 155C that moves each elevator frame 101 up or down an elevator shaft 100 by means of a separate lift cable 136 connected to a separate connection point 140 (not shown) on the exterior of the elevator frame 101 (some can be connected on the rear of each frame) and also connected to a separate lift motor 155 positioned on a lift motor floor 105 of a structure, so that each lift cable 136 and each lift cable connection point 140 can be located outside of the vertical path of each elevator frame 101 as it moves vertically through the elevator shaft 100. For example, frame 101A can be attached to lift motor 155A by lift cable 136A.

The base 102 of each elevator frame 101 can support a horizontally mobile elevator cabin 160 which can be firmly connected to each elevator frame 101. The passengers who are shown as inside each elevator cabin 160 are standing on the top of each elevator cabin floor 107. When both an elevator frame 101 and an elevator cabin 160 are connected to each other they can also be referred to as an elevator cab 110. All of the elevator cabs 110 operating in an elevator shaft 100 can be vertically aligned. Each elevator cab 110 suspended in elevator shaft 100 can be capable of moving vertically throughout an elevator shaft 100 independently of all of the other elevator cabs 110, because all horizontally and vertically separated suspension cables 135, all lift cables 136, all horizontally and vertically separated connection points 140, all guides 150, and all other elements of the elevator system can be located outside of the path of each elevator cab 110 as it moves vertically through an elevator shaft 100. On the other hand, most conventional elevator cabs cannot move independently of one another in the same elevator shaft, because most current and conventional elevator cabs are suspended by suspension cables that are connected to the top center of each elevator cab, and this centralized connection place obviously prevents more than one elevator cab from operating in the same elevator shaft.

Figure 2:
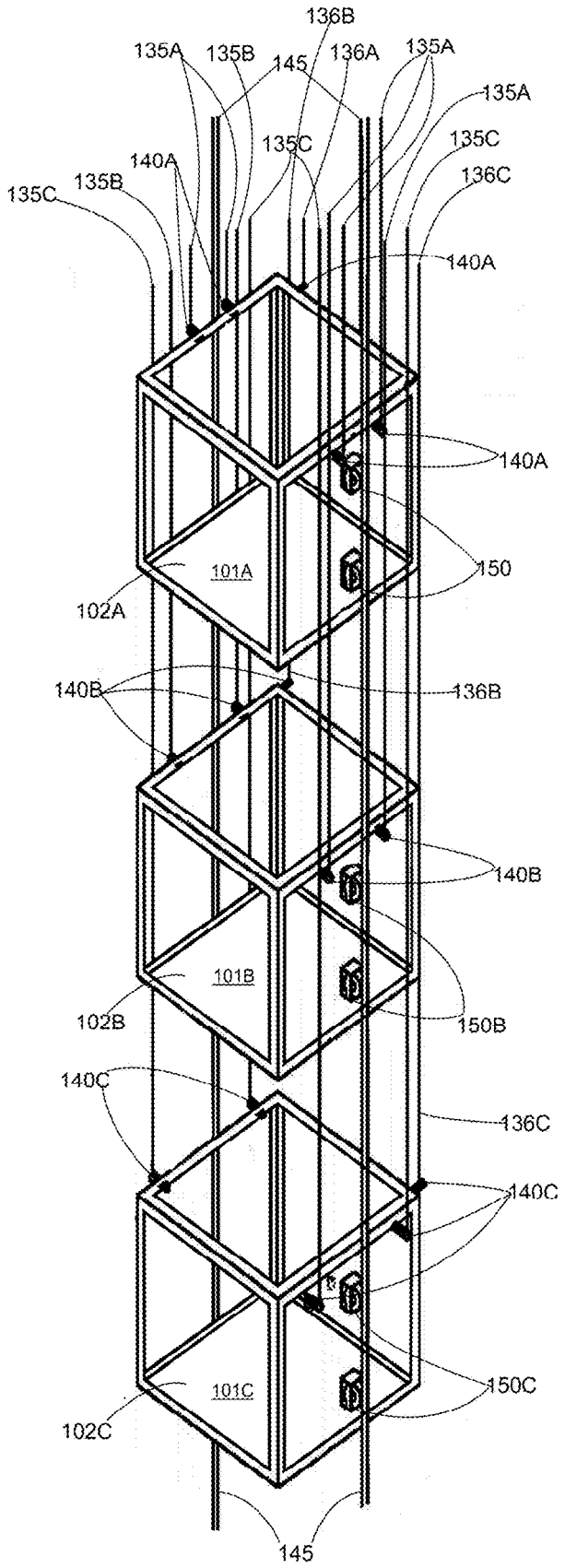
FIG. 2 is an illustration of three empty elevator frames, their suspension cables, connection points, guides and guide tracks, viewed from an oblique perspective, according to one embodiment of the present invention.

FIG. 2 is an illustration of three empty elevator frames 101A, 101B, 101C, their suspension cables 135, their connection points 140, some of their guides 150, and their guide tracks 145, from a different perspective, according to one embodiment of the present invention. As shown in FIG. 2 there can be numerous separate connection points 140 that are separated horizontally and vertically from each other, which protrude outwardly from each elevator frame 101, and away from the vertical path of each elevator frame 101 as it moves through elevator shaft 100. Also, as shown on FIG. 2, all of said suspension cables 135 and all of said elevator lift cables 136 can be systematically, horizontally and vertically separated from each other. All of the above features enable a plurality of elevator frames 101 to move independently of each other through the same elevator shaft 100 in any direction, either up or down. All of these features can also provide an elevator system for the descriptions and explanations according to embodiments of the current invention.

Figure 3:
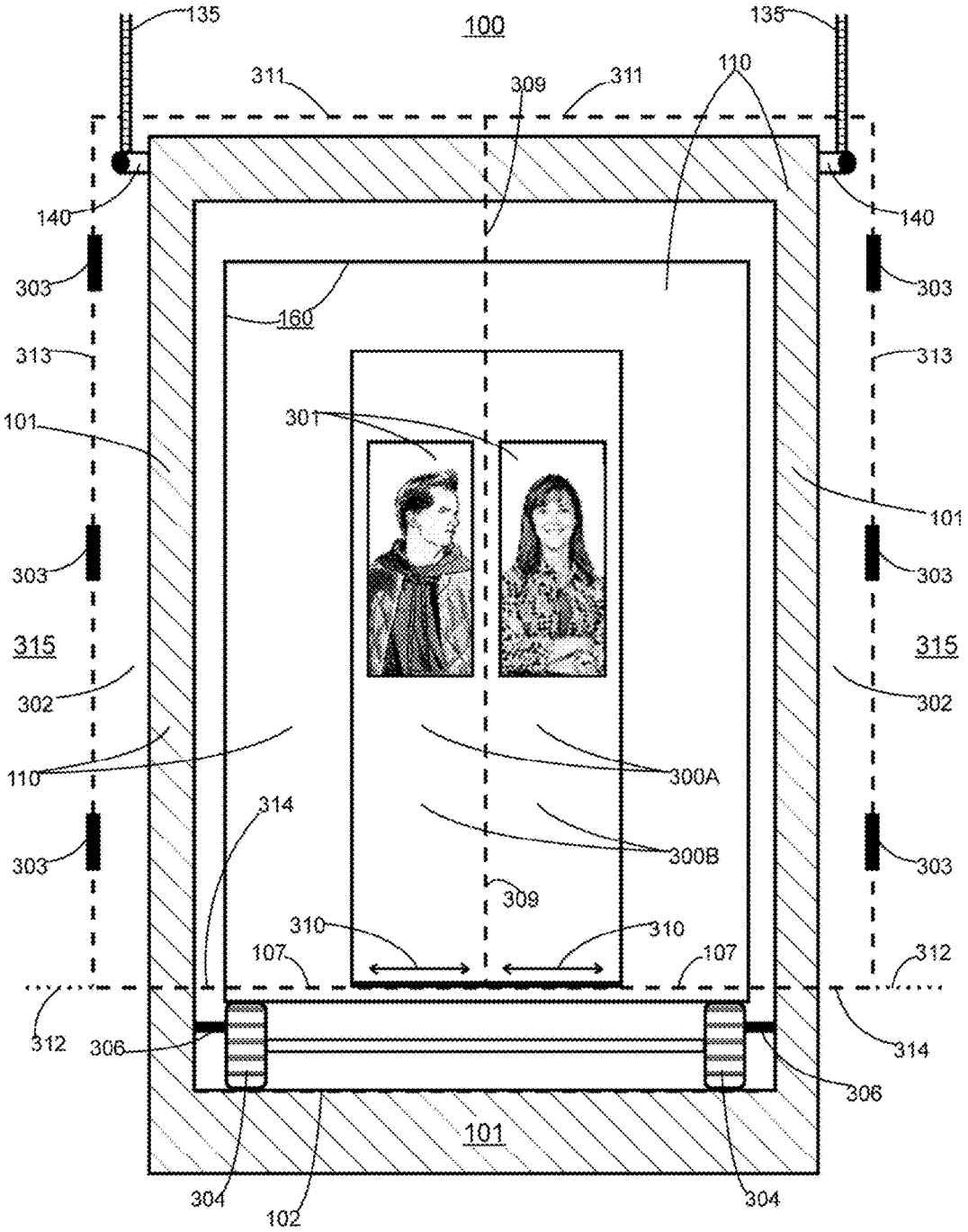
FIG. 3 is an illustration of the front view of an elevator frame suspended by cables in an elevator shaft, with a horizontally mobile elevator cabin positioned within the elevator frame and supported by the base of the elevator frame, according to one embodiment of the present invention.

FIG. 3 is an illustration of the front view of an elevator frame 101 suspended by cables 135, all of which cables can be connected to connection points 140, in an elevator shaft 100, with a horizontally mobile elevator cabin 160 positioned within an elevator frame 101, supported by an elevator frame base 102, and stabilized within the elevator frame 101 by two or more stabilization rods (or other stabilization devices) 306, according to one embodiment of the present invention. When the elevator frame 101 arrives at a floor of a building/structure, one of two scenarios can happen: 1) the top of an elevator cabin floor 107 (shown as a dashed line) can stop at the level of a building floor 312 (shown here as a dotted line) so that passengers in the elevator cabin 160 can exit through two open cabin sliding doors 300A (not shown as open) and two open lobby sliding doors 300B (not shown separately or as open) onto a building floor 312 and waiting passengers can also enter into the elevator cabin 160 through said open sliding doors 300A and 300B; or 2) the top of the elevator frame base 102 can stop at the level of a building floor 312 so that telescoping stabilization rods 306 can be automatically withdrawn into the elevator frame 101 (not shown as withdrawn), a pair of swinging lobby doors 302 can fully open on their hinges 303 (not shown as open), and a plurality of motorized wheels 304, such as four motorized wheels 304, (two rear wheels are not shown), positioned under the elevator cabin 160 can propel the horizontally mobile elevator cabin 160 (with or without passengers inside) onto the floor 312 of a building (such passengers can be seen through the windows 301 in the elevator cabin's sliding doors 300A). The tops of said swinging doors 302 can be shown by the dashed lines 311, the bottoms of said swinging doors 302 can be shown by dashed lines 314, each side of said swinging doors 302 can be shown by dashed lines 313, and the center of said swinging doors 302 can be shown by a dashed line 309. Each lobby sliding door 300B can be positioned inside of a swinging door 302, for example suspended on a track, and can slide to and fro 310 within said swinging doors 302. As shown, each lobby swinging doors 302 can be attached to a wall 315 of an elevator shaft 100 by hinges 303. All four sliding doors, 300A and 300B, can open or close in unison.

After all passengers have walked through the open sliding doors 300 in scenario no. 1, all sliding doors 300 can close in unison and the elevator cab 110 can then move vertically up or down in elevator shaft 100 to another destination floor. On the other hand, in scenario no. 2, after four motorized wheels 304 have propelled a horizontally mobile elevator cabin 160 through the open lobby swinging doors 302, said swinging doors 302 can close in unison. The empty elevator frame 101 can then move up or down to another destination floor, and the horizontally mobile elevator cabin 160 can be propelled on its motorized wheels 304 to another destination on said building floor 312.

Figure 4:
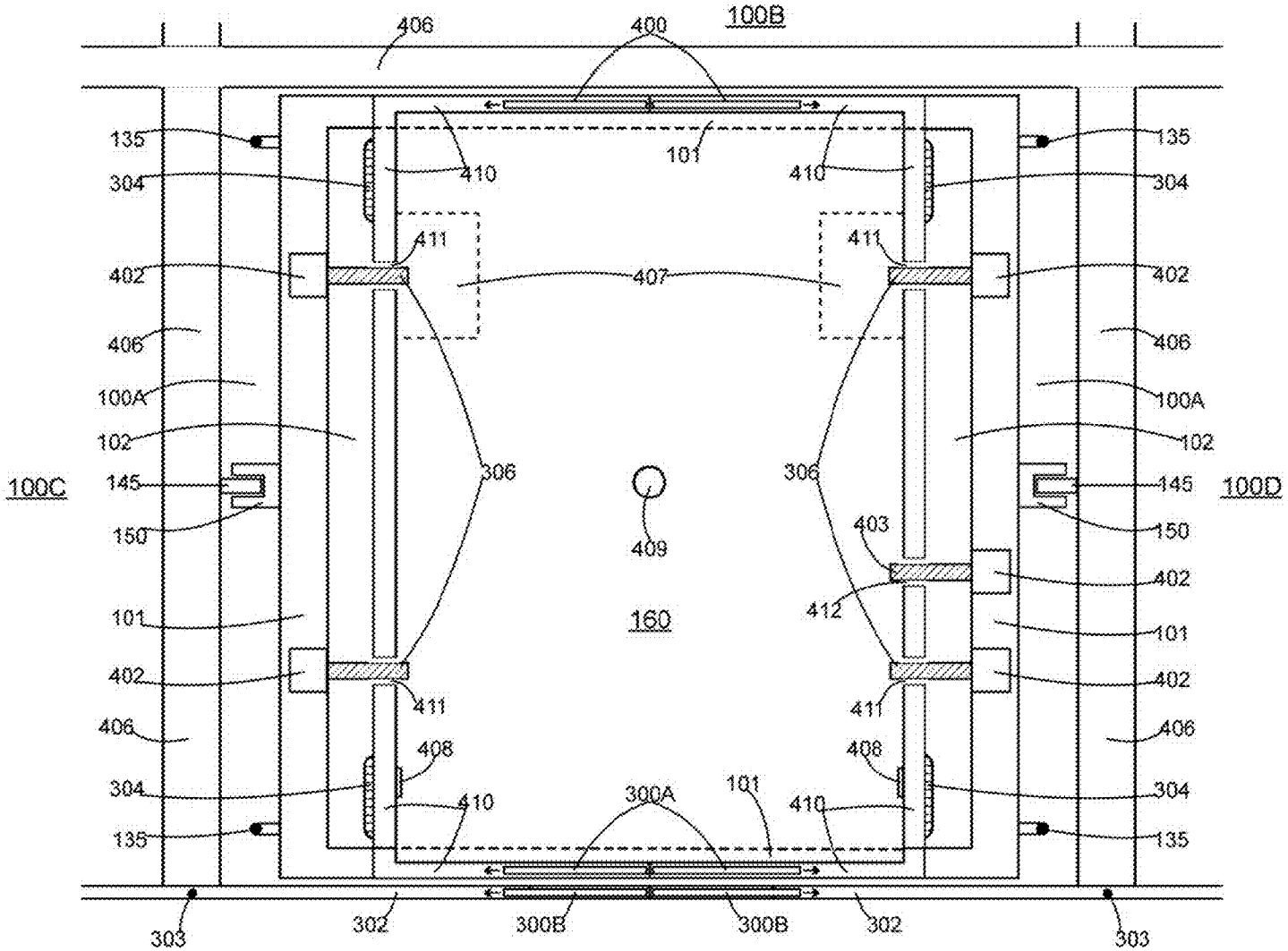
FIG. 4 is an illustration of the top view of an elevator frame suspended by cables in an elevator shaft, with a horizontally mobile elevator cabin positioned within the elevator frame and stabilized by four rods, according to one embodiment of the present invention.

FIG. 4 is an illustration of the top view of an elevator frame 101 suspended by cables 135, and guided by guides 150 along guide tracks 145 in an elevator shaft 100A formed by girders 406, with a horizontally mobile elevator cabin 160 supported by the base 102 of the elevator frame 101, and stabilized by four telescoping stabilization rods 306, according to one embodiment of the present invention. A pair of cabin sliding doors 300A can be shown as closed within a cabin wall 410 at the front end of the elevator cabin 160, and a pair of lobby sliding doors 300B can be shown as closed within a pair of lobby swinging doors 302, which can be hung on hinges 303. At the rear end of the elevator cabin 160 there can be another pair of cabin sliding doors 400 which can be shown as closed within an elevator cabin wall 410 at the rear end of the elevator cabin 160. Four telescoping stabilization rods 306 can be shown as extended into four sleeves 411 located within the sides of the elevator cabin 160, by means of motors 402. Similarly, a telescoping electricity and data plug 403 can be automatically extended into a socket 412 located in a side of the elevator cabin 160 by means of a motor 402. Inside the elevator cabin 160, pull down seats 407 can be provided for horizontally moving passengers, building floor destination buttons 408 can be installed within cabin walls 410, and a ceiling light and video camera 409 can be installed within the cabin 160.

Also as shown in FIG. 4, a horizontally mobile elevator cabin 160 can be driven onto the base 102 of an elevator frame 101 by means of the cabin's motorized wheels 304 and positioned in the center of the elevator frame 101 by means of a steering mechanism (not shown) which can steer said motorized wheels 304 as guided by a guiding mechanism, such as a laser beam (not shown). Each elevator frame 101 in an elevator shaft 100A can be guided vertically along said elevator shaft 100A by a guiding means 150 moving along a vertical guide track 145 which is positioned along each side of an elevator shaft 100A. Each elevator shaft 100 in a structure can be constructed of building girders 406 through which each elevator frame 101 and its suspension cables 135 can move. Two or more elevator shafts 100 can be constructed side by side or end to end, 100A, 100B, 100C and 100D, as shown in FIG. 4.

Figure 5:
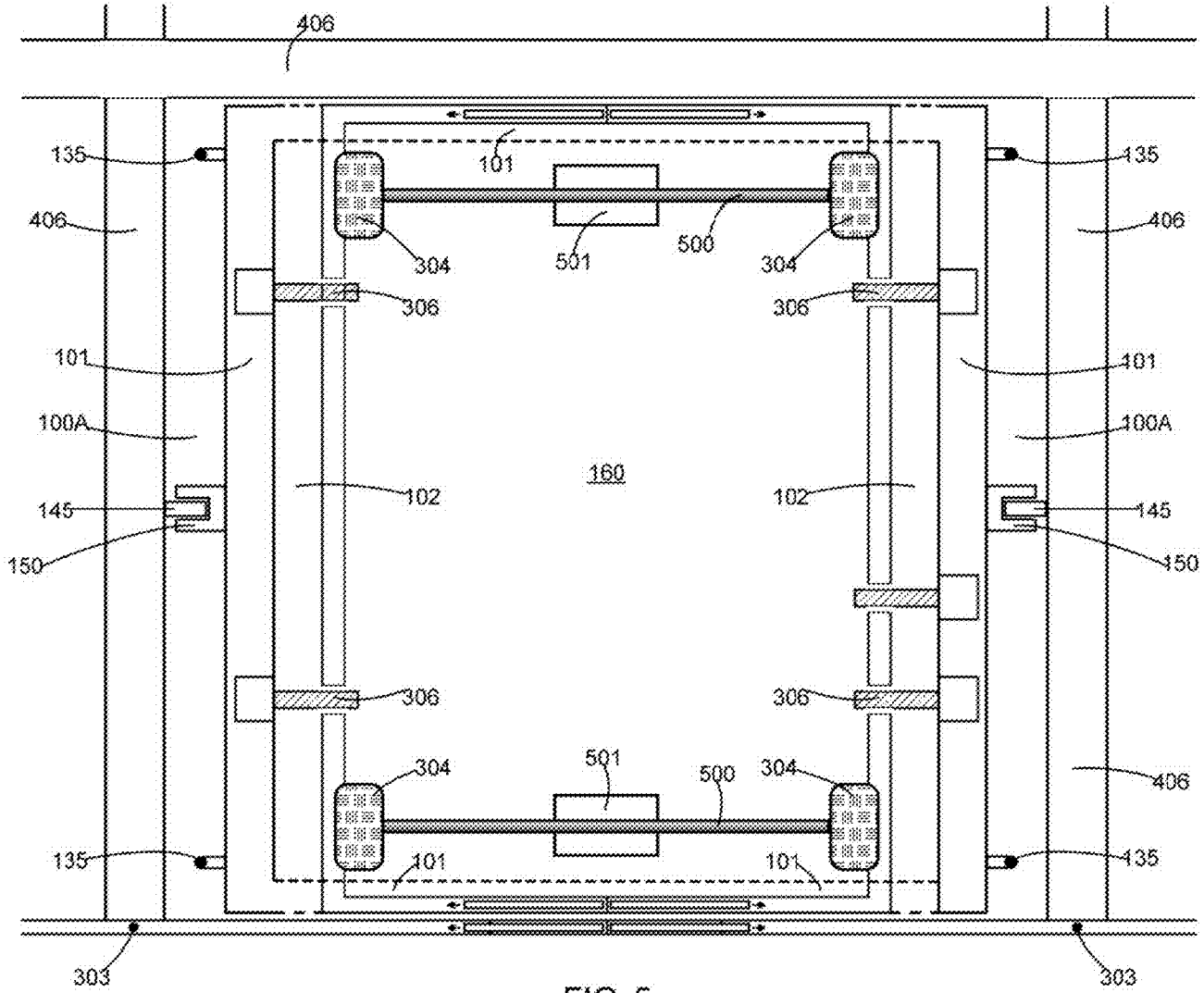
FIG. 5 is an illustration of the bottom view of an elevator frame suspended by cables in an elevator shaft which shows the positions of the cables, the cabin, and the motorized wheels of a horizontally mobile elevator cabin positioned within the frame, according to one embodiment of the present invention.

FIG. 5 is an illustration of the bottom view of an elevator frame 101 suspended by cables 135 and guided by guides 150 along guide tracks 145 in an elevator shaft 100A formed by girders 406, with a horizontally mobile elevator cabin 160 supported by the base 102 of an elevator frame 101 and stabilized by four telescoping stabilization rods 306, according to one embodiment of the present invention. Each motorized wheel 304 of elevator cabin 160 can be connected by an axle 500, and all motorized wheels 304 can be propelled by one or more propulsion motors 501. Each motorized wheel 304 can be steerable by means of a steering mechanism (not shown). Each motorized wheel 304 can also be brakable by means of a braking mechanism (not shown). Each horizontally mobile elevator cabin 160 can also be horizontally guidable by means of a guiding mechanism (not shown), such as magnetic guides and metal wires, laser guides, electronic sensors and/or other suitable guiding mechanisms (not shown).

Figure 6:
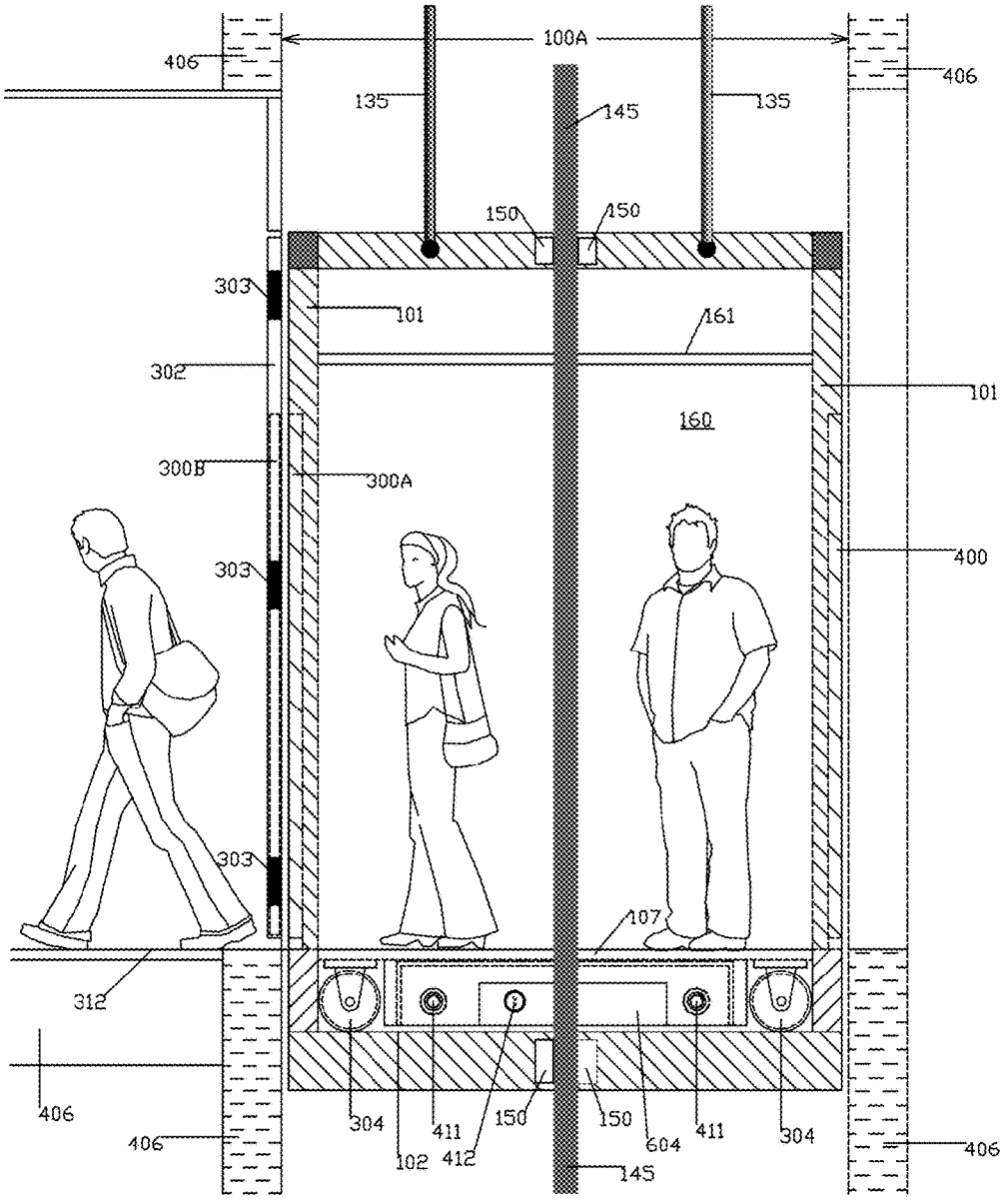
FIG. 6 is an illustration of a side view of an elevator frame suspended by cables in an elevator shaft with a horizontally mobile elevator cabin supported by the base of the elevator frame, and passengers in the cab, some of whom are exiting the cab through its open sliding doors onto the floor of a building, according to one embodiment of the present invention.

FIG. 6 is an illustration of the side view of a stationary elevator frame 101, suspended by cables 135 (two are not shown), and guided by guides 150 along vertical guide tracks 145 in an elevator shaft 100A formed by girders 406, in accordance with one embodiment of the current invention. Positioned within elevator frame 101 can be a horizontally mobile elevator cabin 160 with passengers exiting the floor 107 of the cabin 160 onto floor 312 of a building through open sliding doors 300A and 300B (not shown as open). The top 161 of elevator cabin 160 is also shown. Open lobby sliding doors 300B (not shown as open) can be shown within closed lobby swinging doors 302 that are supported by hinges 303. Closed sliding rear doors 400 can be shown at the rear of elevator cabin 160. The motorized wheels 304 of elevator cabin 160 can be supported by the base 102 of elevator frame 101. Elevator cabin 160 can be stabilized by four telescoping stabilization rods 306 (not shown) automatically inserted into four stabilization sleeves 411 (two are not shown) on the sides of the elevator cabin 160. A telescoping electricity and data plug 403 (not shown) can be automatically inserted into an electricity and data socket 412 on a side of the elevator cabin 160 in order to provide electricity and data to the cabin 160 while it is moving vertically in an elevator shaft 100A, and electricity to charge a battery 604 for the horizontally mobile elevator cabin 160. As shown in FIG. 6 there can be an electricity storage battery 604 attached to the cabin 160 which can be used as energy for motors 501 (not shown) to propel the horizontally mobile elevator cabin 160 when it is detached from the elevator frame 101 and moves horizontally on a surface.

Figure 7:
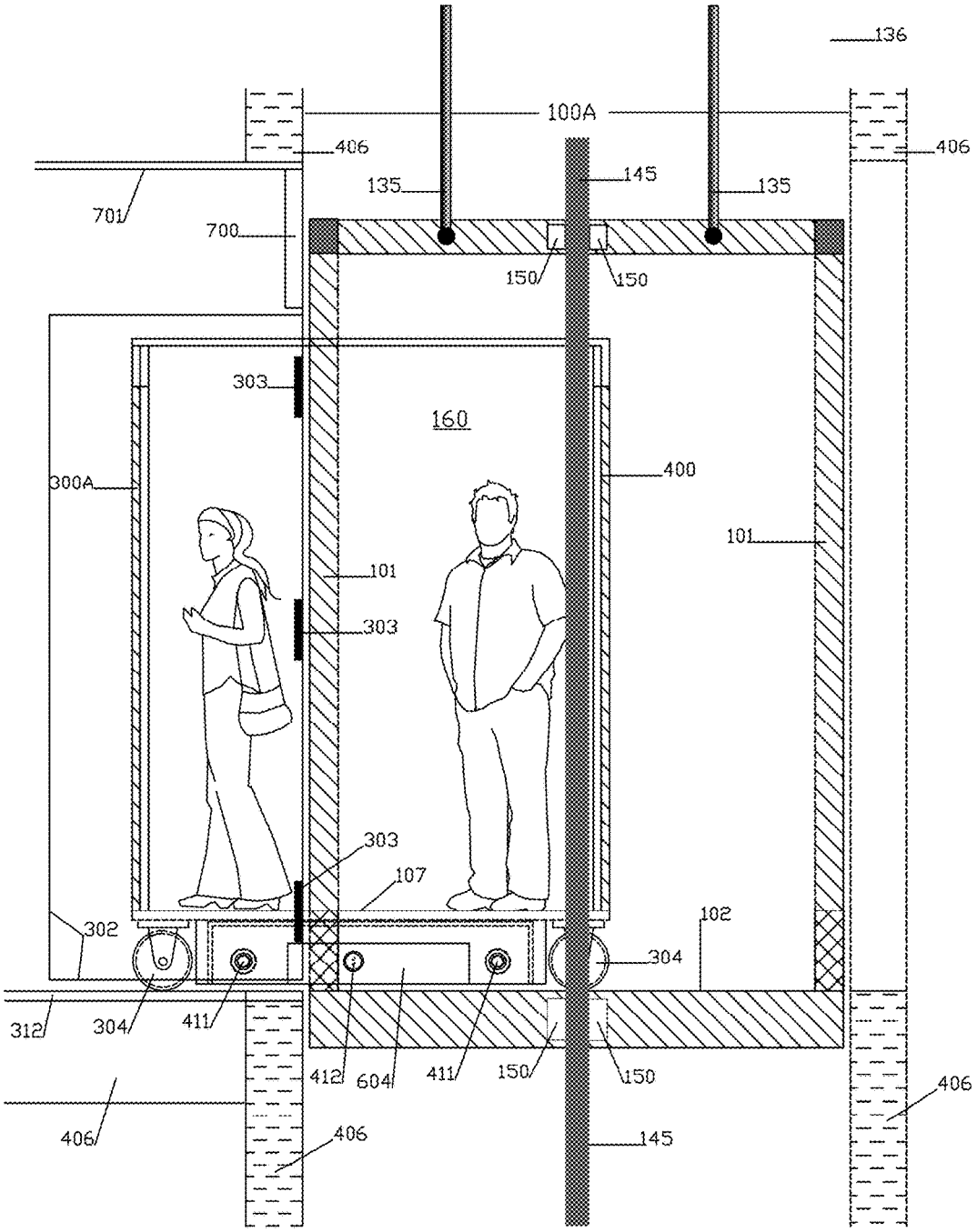
FIG. 7 is an illustration of a side view of a stationary elevator frame suspended by cables in an elevator shaft with a detached horizontally mobile elevator cabin moving out of the frame through open swinging lobby doors and onto the floor of a building, with passengers riding inside of the moving cab, according to one embodiment of the present invention.

FIG. 7 is an illustration of the side view of a stationary elevator frame 101, suspended by cables 135 (two are not shown), and guided by guides 150 along vertical guide tracks 145 in an elevator shaft 100A formed by girders 406, all in accordance with one embodiment of the current invention. The top of the base 102 of the elevator frame 101 can be shown at the same level as the floor 312 of a building/structure. Both swinging lobby doors 302 can be swung wide open and can be hanging from their hinges 303. A pair of cabin front sliding doors 300A can remain closed and a pair of cabin rear sliding doors 400 can also remain closed. A wall 700 of the elevator lobby and a ceiling 701 above the lobby are shown in FIG. 7. Telescoping stabilization rods 306 (not shown) can have already been automatically withdrawn from stabilization sleeves 411 and into the elevator frame 101 by means of stabilization rod motors 402 (not shown). Similarly a telescoping electricity and data plug 403 (not shown) can have already been automatically withdrawn from an electricity and data socket 412 and into the elevator frame 101 by means of an electricity and data motor 402 (not shown). At this point in time, a horizontally mobile elevator cabin 160 can be propelled out of the elevator frame 101 on its motorized wheels 304 (two are not shown) and onto the surface of the floor 312 of a building or other structure, with or without passengers inside the elevator cabin 160.

Once completely outside of the elevator frame 101, the horizontally mobile elevator cabin 160, with or without passengers on board, can be propelled by its motorized wheels 304 on any horizontal surface as far as the electric charge in its batteries 604 can last. For example, the elevator cabin 160 can travel to other destinations on the building floor 312; it can travel across a bridge from one building to another building (not shown); and if a compatible elevator frame 101 in a second building is empty, it can enter through other open lobby swinging doors 302 and move into that second frame 101 (not shown). At this point in time, other telescoping stabilization rods 306 can be automatically inserted into the stabilization sleeves 411 of the elevator cabin 160 (not shown) and another telescoping electricity and data plug 402 can be automatically inserted into an electricity and data socket 412 of the cabin 160 (not shown). Once the other swinging lobby doors 302 (not shown) are closed, this new elevator cab 110 can move vertically again up or down in this new elevator shaft 100B in the second building (not shown).

Figure 8:
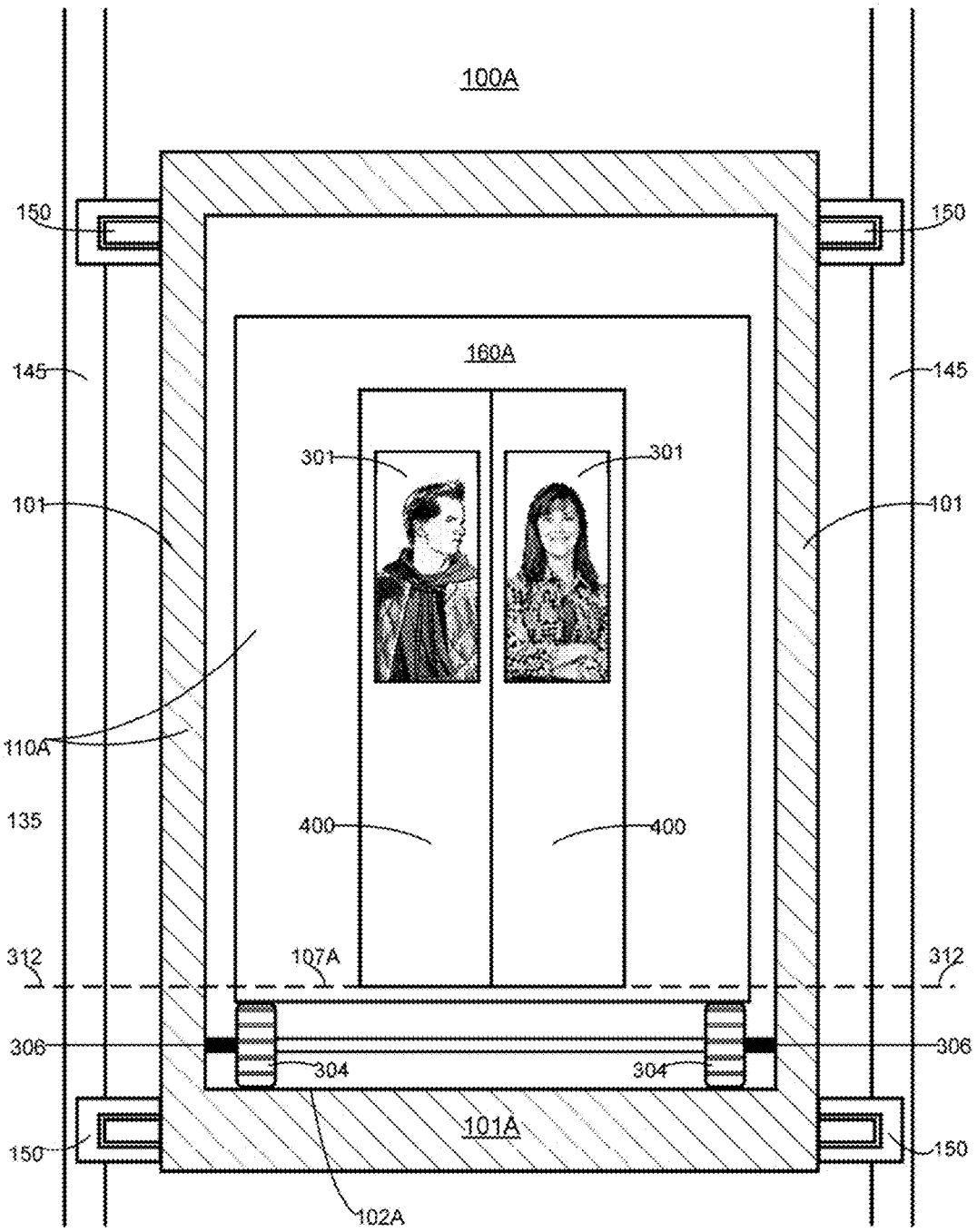
FIG. 8 is an illustration of the rear end view of an elevator frame in an elevator shaft, with a horizontally mobile elevator cabin positioned within the frame and passengers inside the cabin waiting to exit the rear sliding doors of the cabin and walk into the open sliding rear doors of another cabin situated in an adjacent elevator shaft (not shown), according to one embodiment of the present invention.

FIG. 8 is an illustration of the rear view of an elevator frame 101A guided by guides 150 along two vertical guide tracks 145 through an elevator shaft 100A, in accordance with an embodiment of the current invention. Positioned within elevator frame 101A can be the rear view of a horizontally mobile elevator cabin 160A. The cabin's motorized wheels 304 can be supported by the top of the elevator frame's base 102A, and elevator cabin 160A can be stabilized by telescoping stabilization rods 306. Two sliding rear doors 400 can be closed and passengers inside cabin 160A can be visible from the windows 301 located in the sliding doors 400. When elevator cab 110A is moving vertically up or down an elevator shaft 100A, the two rear sliding doors 400 cannot slide open because they must be locked. When elevator cab 110A stops at a building floor 312, one of several scenarios can happen: (1) if the floor 107A of elevator cabin 160A stops at the floor 312 of a building (shown by dashed lines), passengers in the stationary elevator cabin 160A can walk out of the cabin's open front sliding doors 300A and 300B (not shown) onto the surface of floor 312 of a building (not shown). But the rear sliding doors 400 of cabin 160A must remain closed and locked, unless there is another elevator cabin 160B (not shown) waiting in a directly adjacent elevator shaft 100B (not shown) with its floor 107B also stopped at the same floor level 312 (not shown). If this event occurs, the rear sliding doors 400 of both elevator cabins 160A and 160B can automatically unlock and open so that passengers in one stationary elevator cabin 160 can walk across a short floor/connecting platform 800 (not shown) between the two waiting stationary cabins 160 and into the other stationary cabin 160 in accordance with one embodiment of this invention (see FIG. 9 for more detailed descriptions).

On the other hand, (2) if the top of the base 102A of elevator frame 101A stops at the floor 312 of a building, then after elevator cabin 160A can be automatically detached from elevator frame 101A, and horizontally mobile elevator cabin 160A can move out of frame 101A on its motorized wheels 304, either: (a) through the open swinging lobby doors 302 and onto the building lobby floor 312 (not shown), or (b) if the base 102B of another empty elevator frame 101B is waiting in an adjacent elevator shaft 100B at the same building floor level 312, then horizontally mobile elevator cabin 160A can move out of frame 101A in shaft 100A on its motorized wheels 304, across a short floor/connecting platform 800 (not shown), and into empty elevator frame 101B waiting in elevator shaft 100B (not shown), where cabin 160A can be automatically reattached to frame 101B. Elevator frame 101B can then move vertically again up or down elevator shaft 100B with elevator cabin 160A on board, in accordance with one embodiment of the present invention (see FIG. 10 for more detailed descriptions).

Figure 9:
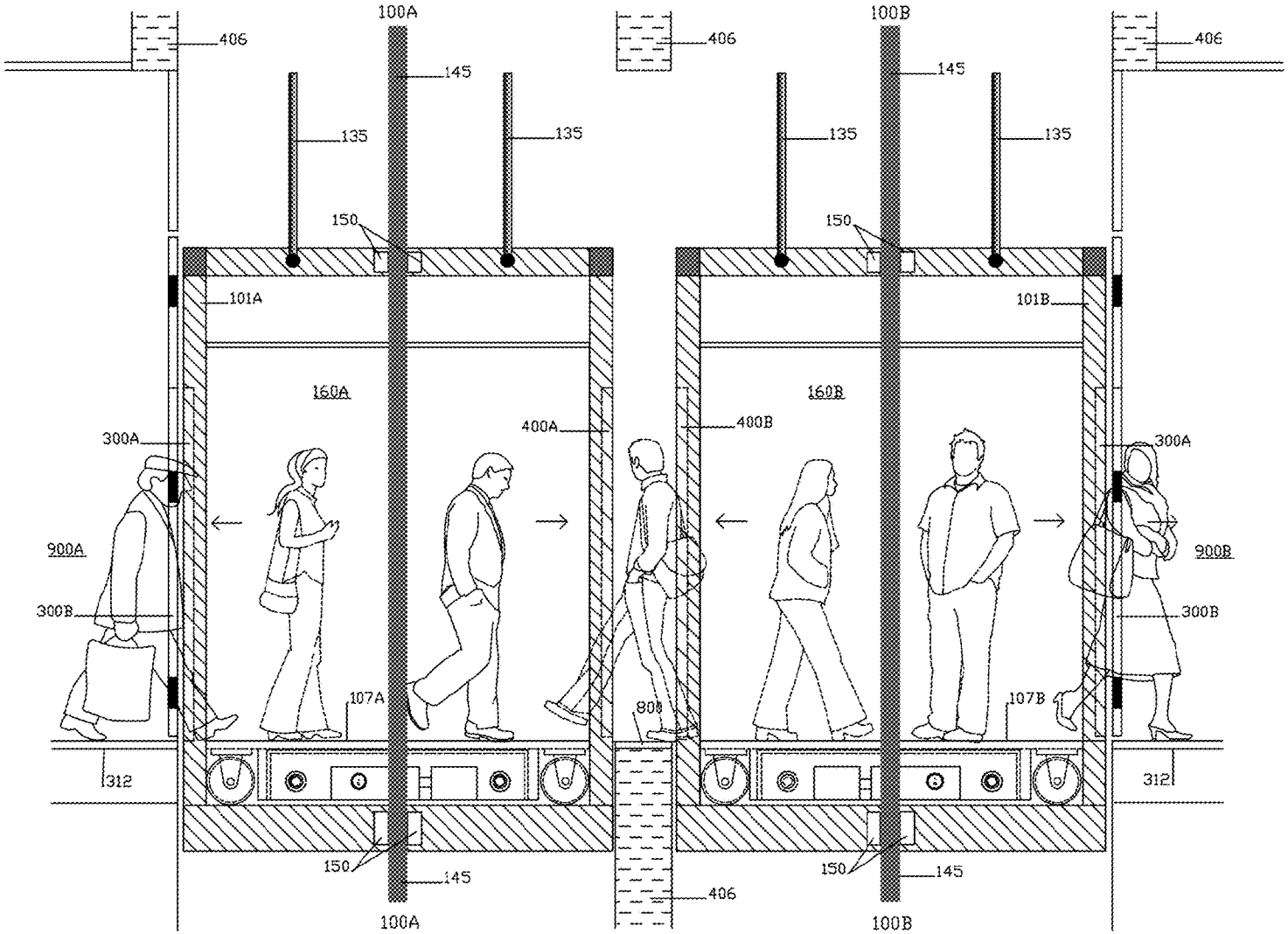
FIG. 9 is an illustration of a side view of two stationary elevator frames, each suspended by cables in a different elevator shaft, with horizontally mobile elevator cabins positioned in each elevator frame, and passengers walking from one cabin through open sliding rear doors of one cabin, across a short floor, and through open sliding rear doors of another adjacent elevator cabin, according to one embodiment of the present invention.

FIG. 9 is an illustration of the side view of two stationary elevator frames 101A and 101B each suspended by suspension cables 135, guided by guides 150 along guide tracks 145 in two adjacent elevator shafts 100A and 100B, respectively and separated by a short floor/connecting platform 800 supported by a building girder 406, in accordance with one embodiment of the current invention. Positioned within elevator frame 101A can be a horizontally mobile elevator cabin 160A, and positioned within elevator frame 101B can be a horizontally mobile elevator cabin 160B. The rear sliding doors 400A and 400B of each elevator cabin 160A and 160B, respectively, can be open, so that passengers in stationary cabin 160A can walk across a cabin floor 107A in cabin 160A through open rear sliding doors 400A and 400B, across a short floor/connecting platform 800 supported by a girder 406, and into stationary cabin 160B without accessing a lobby 900. Likewise, passengers in stationary cabin 160B can walk across a cabin floor 107B in cabin 160B through open rear sliding doors 400B and 400A, across a short floor/connecting platform 800 supported by a girder 406, and into stationary cabin 160A without accessing a lobby 900. Similarly, if rear sliding doors 400B and 400A can remain open, if front sliding doors 300A of elevator cabins 160A and 160B can remain open, and if the front lobby sliding doors 300B of each building lobby 900A and 900B can also remain open, then all passengers in each stationary elevator cabin 160A and 160B and in each lobby 900A and 900B can access each said cabin and each said lobby, as shown on FIG. 9.

Figure 10:
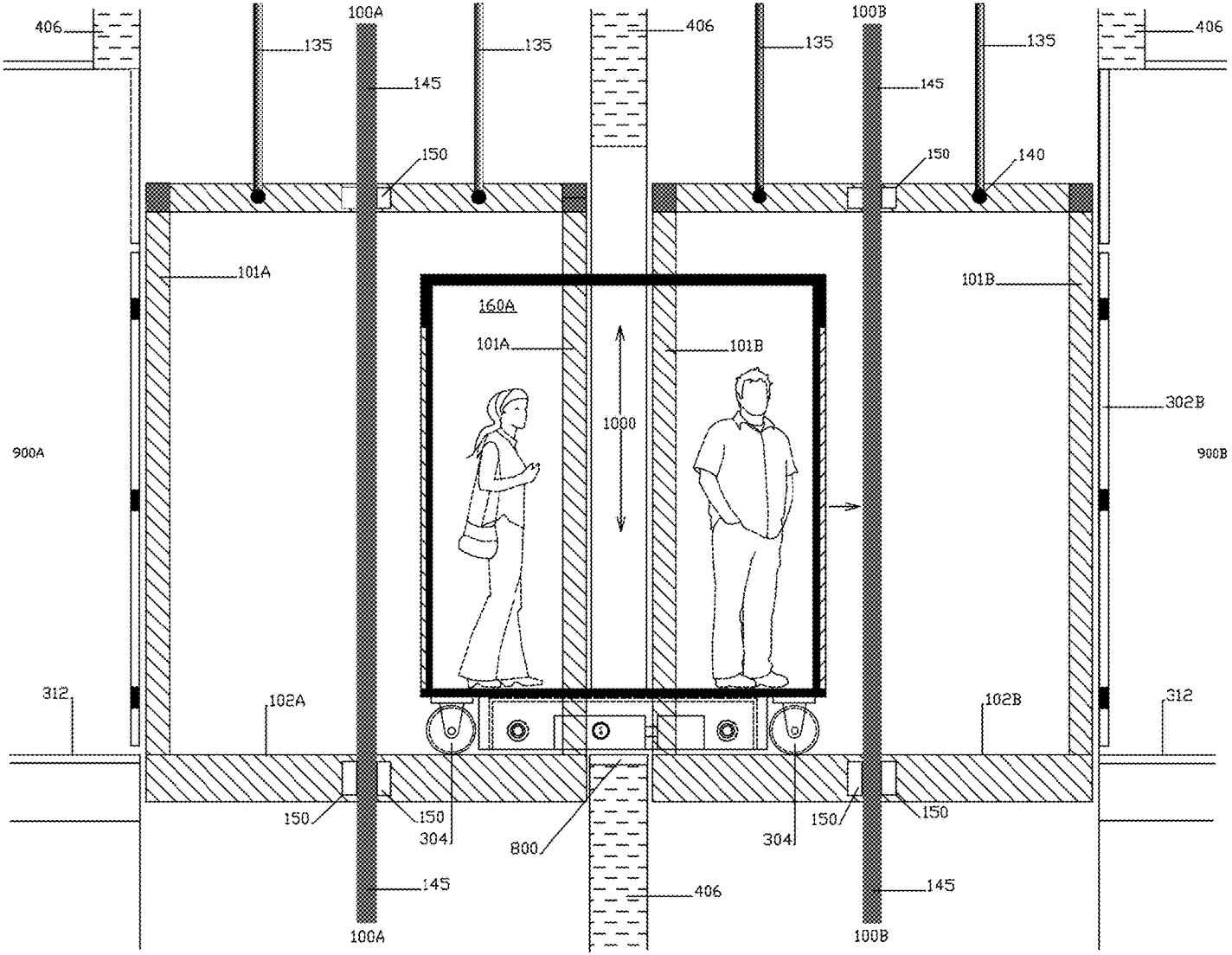
FIG. 10 is an illustration of the side view of two stationary elevator frames, each suspended by cables in a different elevator shaft, with a horizontally mobile elevator cabin, moving on motorized wheels from one elevator frame, across a short floor and onto the base of an adjacent empty elevator frame, according to one embodiment of the present invention.

FIG. 10 is an illustration of the side view of two stationary elevator frames 101A and 101B, each suspended by cables 135, guided by guides 150 along guide tracks 145 in two adjacent elevator shafts 100A and 100B formed by girders 406 and separated by a short floor/connecting platform 800 supported by girders 406, in accordance with one embodiment of the current invention. The base 102A and 102B of each elevator frame 101A and 101B, respectively, can be level with floor 312 of a building/structure. After horizontally mobile elevator cabin 160A is automatically detached from elevator frame 101A, elevator cabin 160A can be propelled by its motorized wheels 304 through the open area 1000 between elevator shaft 100A and elevator shaft 100B, across a short floor/connecting platform 800 supported by a building girder 406, and into elevator frame 101B. At this point in time, horizontally mobile elevator cabin 160A has two options: (1) it can request that lobby swinging doors 302B swing wide open so that horizontally mobile cabin 160A can be propelled on its motorized wheels 304 onto the surface 312 of lobby 900B and move on its motorized wheels 304 to a new destination; or (2) it can remain in elevator frame 101B. Once positioned in frame 101B, elevator cabin 160A can be automatically reattached to other telescoping stabilization rods 306 (not shown) and to another telescoping electricity and data plug 403 (not shown) by means of motors 402 (not shown). Thereafter, elevator frame 101B with horizontally mobile elevator cabin 160A firmly reattached, can move vertically up or down elevator shaft 100B. In embodiments of the present invention, one or more temporary passageways are provided through one or more elevator shafts, and through one or more stationary elevator frames. Furthermore, each elevator cabin in an elevator shaft can be used as a vertical and/or horizontal carrier of workers and/or materials during construction, remodeling or repair of any floor of such structure.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

What is claimed is:

1. An elevator system in a structure comprising:

at least one vertical elevator shaft and at least one horizontal surface along a horizontal plane of said structure;

two or more elevator cabins wherein each cabin is independently moveable with respect to each other cabin vertically through the at least one vertical elevator shaft and horizontally into the at least one horizontal surface; a pair of elevator cabin sliding doors located within a front wall of each elevator cabin;

at least one vertically moveable elevator frame that is attachable to an elevator cabin of the two or more elevator cabins, wherein the elevator cabin being detachable from said at least one elevator frame and capable of horizontal movement on the at least one horizontal surface; and a pair of lobby sliding doors, wherein each lobby sliding door is suspended on a track within a pair of lobby swinging doors through which the at least one horizontal surface is accessible, and the pair of lobby swinging doors are attached to a wall of the at least one vertical elevator shaft;

wherein the elevator cabin that is detachable from the at least one elevator frame is movable on motorized wheels through the open lobby swinging doors and onto the at least one horizontal surface to a destination away from the at least one vertical elevator shaft.

2. The elevator system of claim 1, wherein each elevator frame is suspended by a plurality of cables and is connected by cables to one or more counterweights.

3. The elevator systems of claim 2, wherein each cable and each counterweight is located outside a vertical pathway of each cabin and each elevator frame.

4. The elevator system of claim 1, further comprising at least a second elevator frame and at least a second elevator cabin that is attached to and supported by said at least second elevator frame.

5. The elevator system of claim 4, wherein one or more of said elevator cabins and frames are independently moveable with respect to each other cabin and frame vertically through the at least one vertical elevator shaft.

6. The elevator system of claim 4, wherein one or more of said elevator cabins is independently moveable with respect to each other elevator cabin vertically through the each elevator shaft and horizontally onto each horizontal surface.

7. The elevator system of claim 1, further comprising at least a second vertical elevator shaft in the structure having another one or more vertically aligned elevator frames, wherein each cabin is detachable from and attachable to each elevator frame in any vertical elevator shaft and along the at least one horizontal surface.

8. The elevator system of claim 1, wherein each elevator cabin is attached to or detached from the elevator frame.

9. The elevator system of claim 1, wherein each elevator cabin is stabilized by at least a pair of stabilization rods located on the elevator frame or on the cabin.

10. The elevator system of claim 1, wherein each elevator cabin further comprises a plurality of wheels for horizontal movement onto the horizontal surface.

11. The elevator system of claim 10, wherein the plurality of wheels are motorized wheels propelled by one or more propulsion motors.

12. The elevator system of claim 11, wherein the motorized wheels of the elevator cabin are steerable, brakable, and guidable.

13. The elevator system of claim 11, wherein energy for the one or more motors that propel the wheels of the elevator cabin is supplied by rechargeable batteries transported with the cabin.

14. The elevator system of claim 13, wherein an elevator cabin of the two or more elevator cabins is detached from a stationary elevator frame suspended by cables in the at least one elevator shaft, then said elevator cabin is movable on the plurality of motorized wheels across a surface of the stationary elevator frame, across the at least one horizontal surface comprising a connecting floor and onto another surface of an adjacent stationary elevator frame suspended by cables in a different elevator shaft, wherein said elevator cabin is reattached to said adjacent elevator frame and then is movable up or down in said different elevator shaft.

15. The elevator system of claim 1, wherein each elevator cabin is supported by a supporting surface of the elevator frame.

16. The elevator system of claim 15, wherein the supporting surface of the elevator frame is aligned with the at least one horizontal surface when the cabin is detached from the elevator frame for horizontal movement.

17. The elevator system of claim 1, wherein each cabin comprises a front entryway and a rear entryway.

18. The elevator system of claim 1, wherein the horizontal surface is a floor in the structure.

19. The elevator system of claim 1, further comprising for at least one elevator cabin, a pair of second sliding doors within a rear wall of the same elevator cabin.

20. The elevator system of claim 1, wherein the pair of elevator cabin sliding doors located in the front wall of at least one elevator cabin open onto the at least one horizontal surface comprising a floor in the structure and are configured for passengers to move through from each elevator cabin that is stationary.

21. The elevator system of claim 20, further comprising two adjacent elevator shafts and wherein said at least one horizontal surface comprises a connecting platform between said adjacent elevator shafts wherein each elevator cabin comprises open rear doors, such that passengers in one adjacent elevator shaft can move across the connecting platform, and into the open rear doors of an adjacent elevator cabin, which adjacent elevator cabin being movable up or down in an adjacent elevator shaft.

22. The elevator system of claim 20, wherein the pair of lobby sliding doors suspended within the pair of lobby swinging doors of the at least one vertical elevator shaft open onto the floor in the structure, each elevator cabin comprising a pair of cabin sliding doors in a rear wall of the elevator cabin, the system comprising the at least one horizontal surface further comprising a connecting platform between the at least one elevator shaft and an adjacent second elevator shaft, and an adjacent elevator cabin suspended in the adjacent second elevator shaft, and a pair of sliding doors suspended within a pair of swinging doors of the adjacent second elevator shaft which open onto another floor of the structure;

such that passengers on the floor move through the pair of lobby swinging doors and pair of lobby sliding doors of the at least one vertical elevator shaft, through the pair of elevator cabin sliding doors in the front wall of a stationary elevator cabin in the shaft, across the stationary elevator cabin, through the pair of cabin sliding doors in the rear wall of the stationary elevator cab, across the connecting platform, through the pair of cabin sliding doors in the rear wall of the adjacent elevator cabin in the adjacent second elevator shaft, across the adjacent elevator cabin, through the pair of cabin sliding doors in the front wall of the adjacent elevator cabin, through the pair of sliding doors and pair of swinging doors of the adjacent second elevator shaft, and onto the another floor.

23. The elevator system of claim 22, wherein a temporary passageway is provided through one or more elevator shafts, and through one or more stationary elevator frames.

24. The elevator system of claim 1, wherein each elevator cabin is detachable from the elevator frame and then moveable on the motorized wheels onto the at least one horizontal surface.

25. The elevator system of claim 1, wherein the elevator cabin that is detachable from the at least one elevator frame moves horizontally on the motorized wheels on the at least one horizontal surface to another structure, moves onto a surface of another stationary elevator frame suspended in another elevator shaft, then attaches to said another stationary elevator frame and is movable up or down in said another elevator shaft.

26. The elevator system of claim 1, wherein each elevator cabin in the at least one elevator shaft can be used as a vertical and/or horizontal carrier of workers and/or materials during construction, remodeling or repair of any of the at least one horizontal surface comprising at least a floor of such structure.

27. The elevator system of claim 1, wherein the two or more elevator cabins operate independently of each other elevator cabin in the same vertical elevator shaft due to all cables and a plurality of connection points being located outside the vertical path of movement of each elevator cabin, as each elevator cabin moves vertically through the vertical elevator shaft.

* * * * *